US005127618A

United States Patent [19]

Pagé et al.

[11] Patent Number: 5,127,618

[45] Date of Patent: Jul. 7, 1992

[54] PIVOTING STAND FOR BOTTLE OF WATER DISPENSER

[76] Inventors: Jean-Pierre Pagé, 42 de l'Oranger, Gatineau, Quebec, Canada, J8V 2C1; Jacques Desjardins, 776, St-Joseph, Hull, Quebec, Canada, J8Y 4B9; Jean-Pierre Desjardins, 448, St. Marc, Gatineau, Quebec, Canada, J8P 5Z6

[21] Appl. No.: 718,753

[22] Filed: Jun. 21, 1991

[30] Foreign Application Priority Data

Jun. 22, 1990 [GB] United Kingdom ..... 9013995

[51] Int. Cl.[5] ..... B65B 3/04

[52] U.S. Cl. ..... 248/313; 222/81; 222/146.6

[58] Field of Search ..... 248/311.3, 313; 222/81, 222/146.6; 137/376

[56] References Cited

U.S. PATENT DOCUMENTS

| | | | |
|---|---|---|---|
| 1,978,832 | 10/1934 | Barhoff et al. | 248/313 |
| 2,631,862 | 3/1953 | Johnson | 248/351 |
| 2,781,152 | 2/1957 | Van Slyke | 222/81 |
| 3,215,388 | 11/1965 | Culver | 248/313 |
| 3,831,813 | 8/1974 | Latham, Jr. | 222/81 |
| 4,040,389 | 8/1977 | Walters | 222/81 X |
| 4,597,423 | 7/1980 | Chenot | 222/146.6 X |
| 4,723,688 | 2/1988 | Munoz | 222/146.6 X |
| 4,770,428 | 9/1988 | Sugiyama | 248/313 X |

*Primary Examiner*—Carl D. Friedman
*Assistant Examiner*—Derek J. Berger
*Attorney, Agent, or Firm*—Roland L. Morneau

[57] ABSTRACT

A water bottle tilting assembly mounted on a water dispensing cabinet is arranged to support the water bottle adjacent the dispensing cabinet at a level so that when the bottle is tilted about an axle the mouth of the bottle automatically reaches the trough of the cabinet with a breakable seal around the mouth of the bottle. A pointed sharp cutter is located inside the trough of the cabinet and breaks the seal when the bottle reaches its upside down position to allow the water to flow in the water dispensing cabinet.

8 Claims, 7 Drawing Sheets

PIVOTING STAND FOR BOTTLE OF WATER DISPENSER

BACKGROUND OF THE INVENTION

Field of the Invention

Many of the water cooler dispensers are now provided with large water bottle which are heavy to manipulate. These full bottles must be lifted, turned upside down and the neck of the bottle must be deposited in a trough while the mouth of the bottle is opened and the water runs out of it. Such an operation can cause a backache, the bottle may be dropped on the floor or at least water may be spilled.

These bottles come with a breakable seal but the seal is removed before the above mentioned operation.

It is the purpose of the present invention to provide a stand for the bottle which can support the bottle in the upstanding position and which can pivot the bottle to its upside down position while maintaining the seal over the mouth of the bottle. When the mouth of the bottle reaches its position over the trough of the water dispenser, a cutter located in the trough automatically cuts the membrane closing the mouth to allow the water to flow in the dispenser.

A search of the prior art has failed to reveal any pertinent references.

SUMMARY OF THE INVENTION

The invention is directed to a water bottle tilting assembly adapted to be mounted on a water dispensing unit. The dispensing unit of the type contemplated has a bottle having a neck and a mouth covered by a breakable seal adapted to be mounted on a cabinet having a peripheral wall and an open trough on its upper surface for receiving the water from the bottle. The assembly comprises a platform for supporting the bottle in an upstanding position adjacent the unit. The bottle has an upwardly directed mouth when standing on the platform. The assembly also comprises a frame made of a collar member and a lateral beam pivotly actuated on the collar member. The collar member is adapted to grip the peripheral wall of the dispensing unit at a level adjacent the opening of the trough. The lateral beam is pending from the collar member adjacent the peripheral wall and is fixed to the platform. A sharp piercing cutter is located in the trough for breaking the seal over the mouth of the bottle when the latter reaches its upside down position to allow the water to flow in the trough.

A leg extending from the platform to the floor is contemplated to solidify the platform when a bottle is sitting on it.

DETAILED DESCRIPTION OF THE INVENTION

Figure 1:
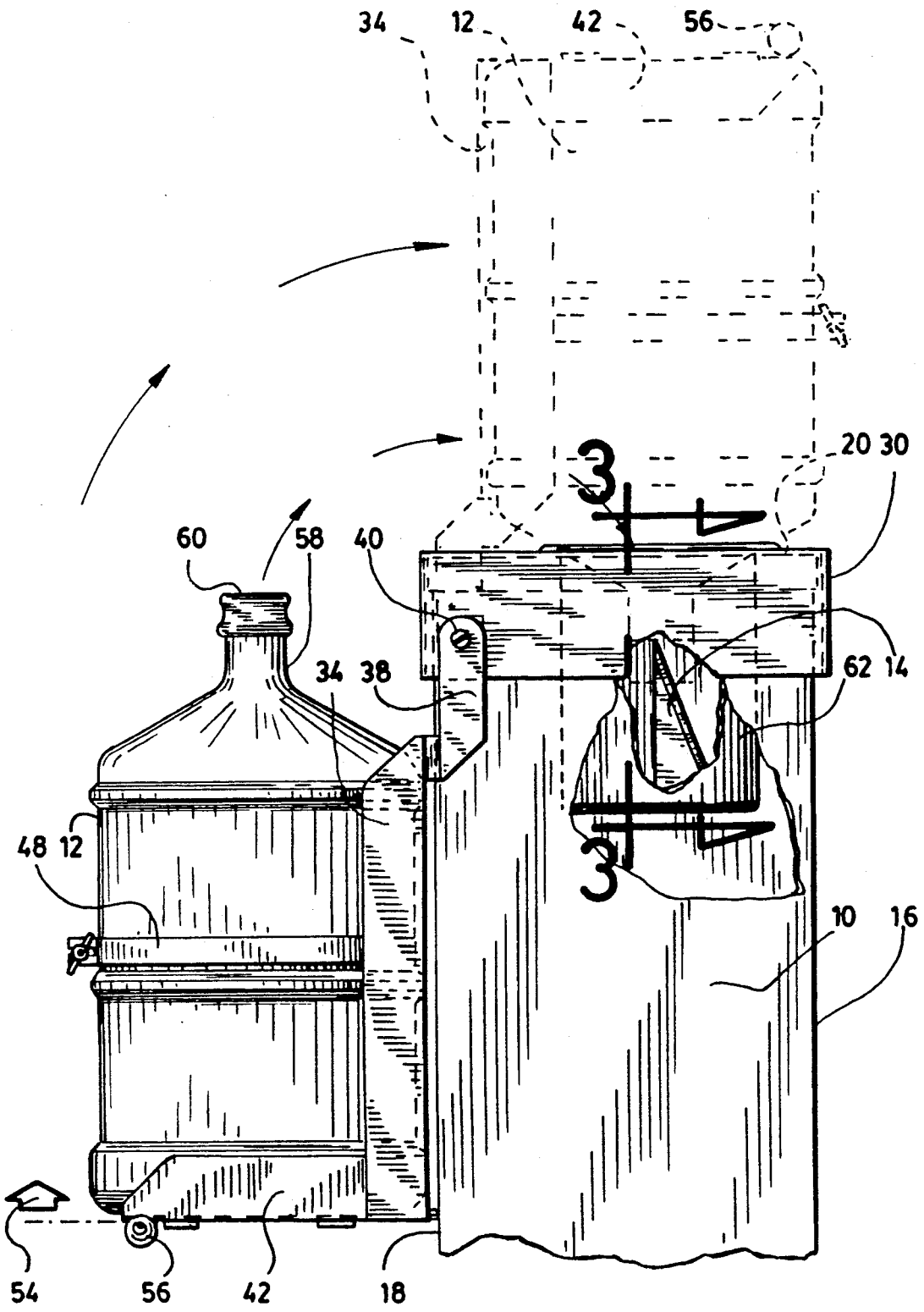
FIG. 1 is an elevation view of the bottle tilting assembly supporting a water bottle and mounted on a water dispenser unit, the latter having a portion cut out.

In FIG. 1 illustrates a commonly known water dispensing cabinet over which a water bottle 12 is adapted to be mounted in an upside down position to allow the water contained therein to flow in the trough 14 of the dispensing unit 10. The dispensing unit 10 has lateral peripheral walls generally illustrated by 16 and 18 and an upper surface 20 of a substantially square contour through which the opening of the trough 14 extends.

Figure 2:
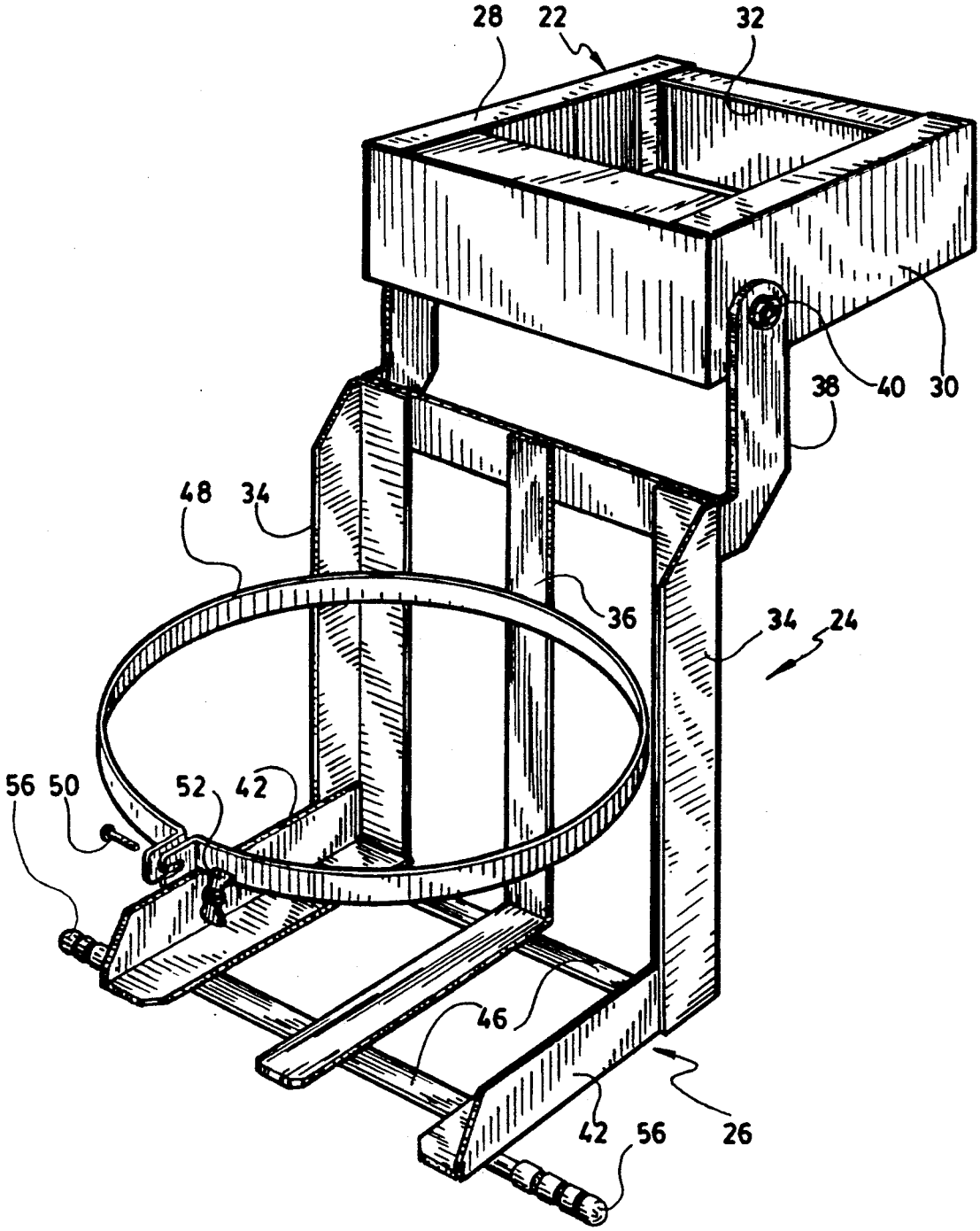
FIG. 2 is a prospective view of the bottle tilting device shown in FIG. 1.
Figure 3:
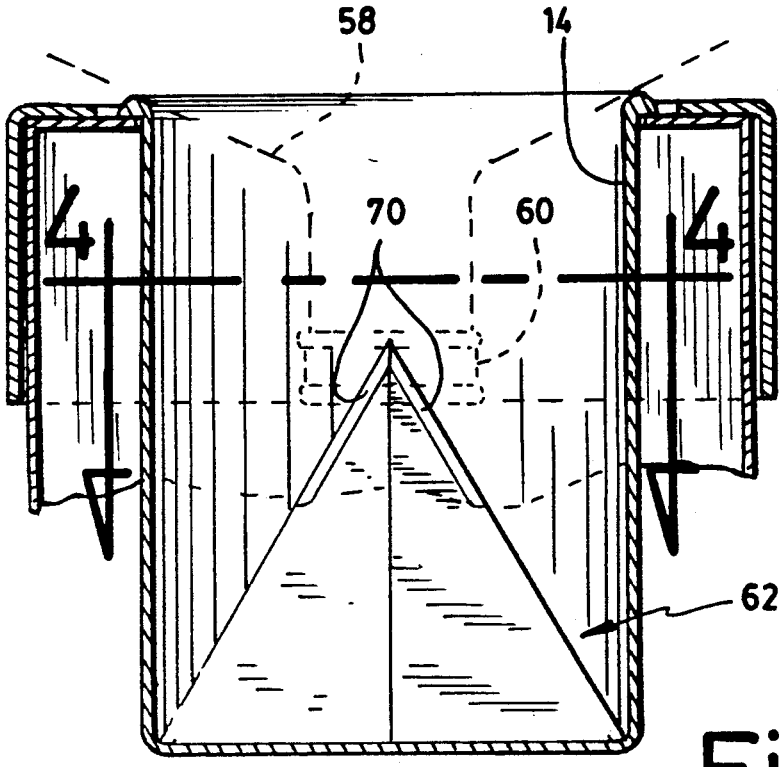
FIG. 3 is a vertical sectional view taken along line 3—3 of FIG. 1 illustrating the trough of the dispensing unit and a cutter for piercing the seal of the bottle.
Figure 5:
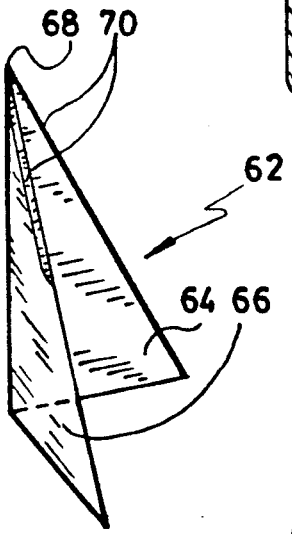
FIG. 5 is a perspective view of the cutter.
Figure 4:
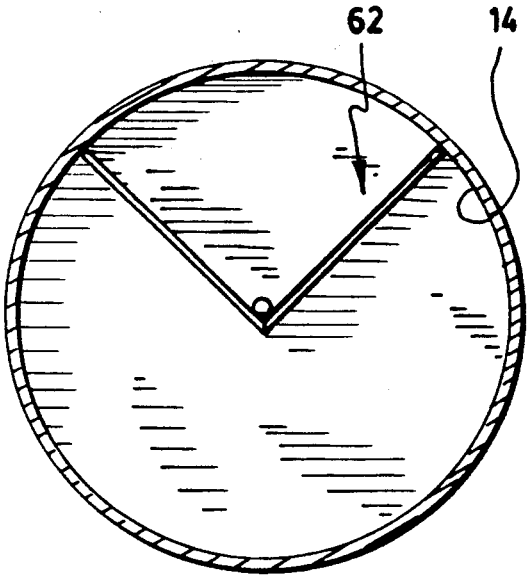
FIG. 4 is a cross-sectional view along line 4—4 of FIG. 3.

The tilting assembly according to the invention is clearly illustrated in FIG. 2 and comprises a collar member 22, a lateral beam 24 and a platform 26.

The collar member 22 is made of a marginal rim 28 and a pending flange 30 abutting against the upper contour of the dispensing unit 10. The marginal rim 28 leaves a central aperture 32 large enough to free the upper opening of the trough 14.

The collar member 22 is made sufficiently solid to support the lateral beam 24 and the platform 26 on which rests a bottle 12. The lateral beam 24 is made of L-shaped brackets 34 and a central plate 36 fixed to a pivoting member 38. The pivoting member 38 hangs from the axle 40, the location of which will be explained later.

The platform 26 also comprises a pair of L-shaped brackets 42 and a central plate 44 connected to each other by a cross-bar 46. The lateral flanges of the brackets 34 and 42 laterally holds the bottle 12 over the platform 26.

In order to additionally secure the bottle over the platform 26, a strap 48 adapted to encircle the bottle 12 is welded to the plate 36 at about mid-height of the bottle. The strap 48 is made of a strong but flexible material which may be split by removing the bolt 50 and the wing nut 52 to allow the removal of the bottle 12 from the platform 26.

In order to facilitate the tilting of the assembly about the axle 40, in the direction of the arrow 54, a pair of lateral handles 56 are provided on each side of the L-shaped brackets 42.

In operation, the bottle 12 is placed on the platform 26 and secured with the strap 48. The bottle 12 is of the type having a neck 58 opening into an upwardly directed mouth covered by a breakable seal 60. The seal 60 is of the type which will tear and open upon the introduction of a sharp object or a cutting knife through the seal 60.

The assembly according to the invention includes a cutter 62 located inside the trough 14. The cutter 62 is made of two triangular pieces 64 and 66 joined together to form a pointed end 68 at their apex. The combination of the two triangular pieces 64 and 66 substantially represents two adjacent faces of a pyramid which can stand firmly on its base. The two triangular pieces 64 and 66 are preferably provided with sharp edges 70 adapted to more positively cut the membrane 60 when the latter comes in contact therewith.

The location of the axle 40 is located at midway between the location of the mouth of the neck 58 of the bottle when the latter is in its upstanding position shown in full line in FIG. 1 and in its upside down position shown in dotted lines in the same FIGURE. Consequently, when the bottle is tilted by pulling upwardly on the handles 56, the mouth automatically reaches the correct position in the trough 14. The apex 68 of the cutter 62 is located to face the center of the breakable seal 60 when the bottle 12 reaches its upside down position. The sharp edges 70 of the plate 64 and 66, the seal 60 which has been broken allows the water in the bottle to flow between the two plates 64 and 66 and fall into the trough 14. The location of the axle 40 is generally located along an axis inside the perimeter of the dispensing unit 10, that is, the pivoting member 38 is located on a plane closer to the trough than the L-shaped bracket 34 so that when the bottle rests on the platform 42, the bracket 34 will firmly abut against the dispensing unit 10.

FIGS. 6–12 illustrate an alternative embodiment of the invention making use of stiff wires. The collar member 72 is connected to the lateral beam 74 through an axle 76. The supporting member 78 is integrally connected to the lateral beam 74 and is preferably resting on a leg member 80 as an additional security for supporting the bottle 82.

The collar member 72 is essentially made of a plurality of orthogonally connected wires 84 and 86 secured to a cross-bar 88 located across the front of the water dispensing cabinet 90. The wires 84 and 86 extend downwardly onto the cabinet to form a collar sufficient to allow the stable support of the bottle when resting on the platform 78.

The lateral beam 74 is preferably made of two portions, that is, a piece of wire 92 extending downwardly from the cross-bar 88 along a plane bisecting the distance between the mouth 94 of the bottle and the middle of the trough 96 of the dispensing cabinet 90. The lateral beam 74 also includes another pending pieces of wire 98 which are inter-connected to angularly disposed wires 100 along a horizontal plane. The distance between the two pending wires 98 is chosen to allow the bottle 82 to abut thereagainst and to lift the bottle when the latter is tilted upwardly. The angularly disposed wire 100 is also preferably located at a height to abut against the shoulder of the bottle 82 so that when the latter is tilted it will provide a support for preventing the bottle from excessively sliding out of its support when the bottle reaches its upside down position.

The platform or supporting member 78 is integrally connected to the pending wire 98. It preferably forms a portion of a circle adjacent the periphery of the bottle 82 and is made of a wire which is sufficiently stiff to easily support a bottle when full of water.

Figures 9, 10:
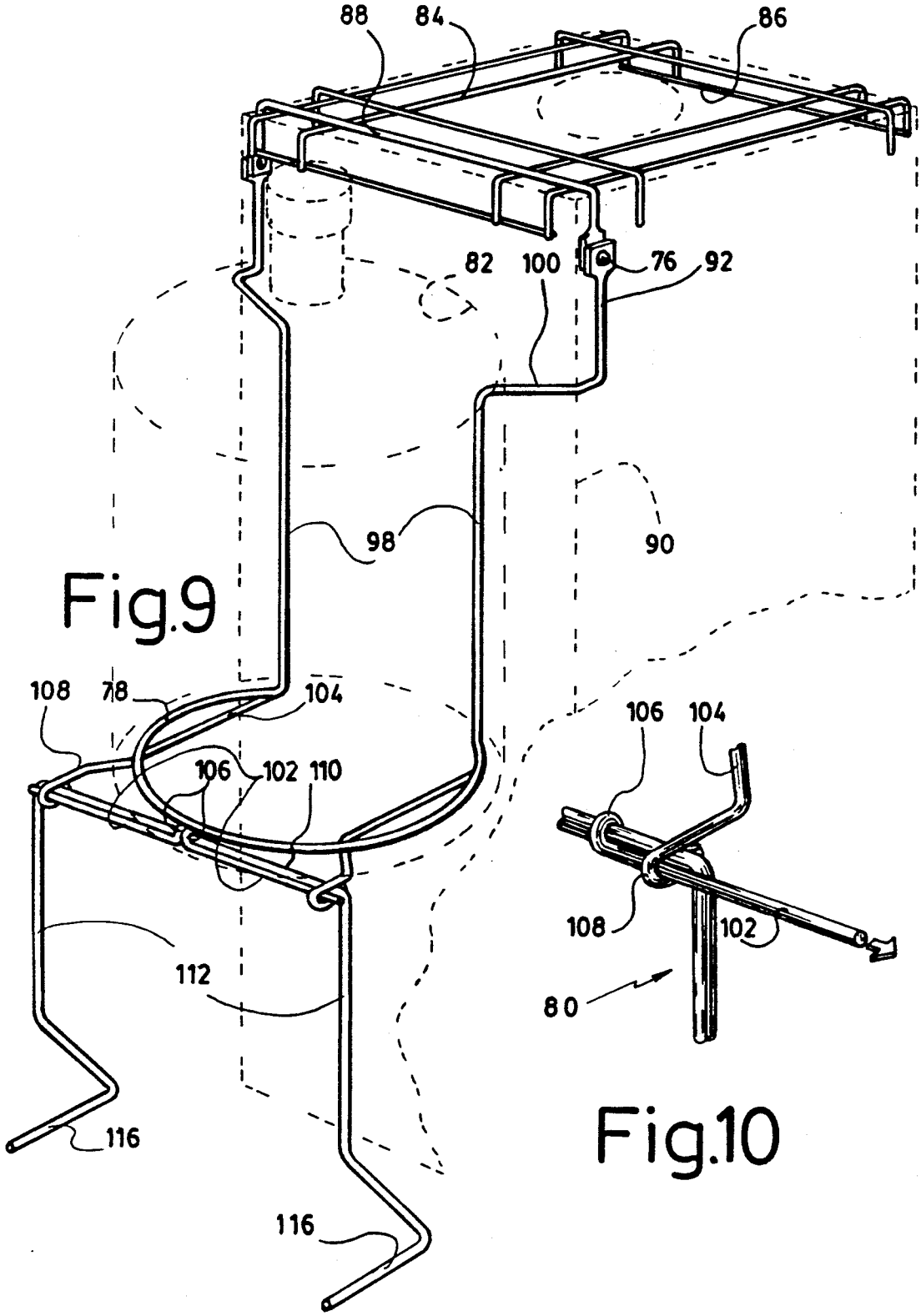
FIG. 9 is a perspective view of the embodiment shown in FIG. 6.
FIG. 10 is a detailed view of the handle of the assembly shown in FIG. 9 for tilting the assembly.

In order to facilitate the lifting and tilting of the bottle, a pair of handles 102 are supported in front of the bottle by brackets 104 extending from the platform 78. The handles 102 are made of a piece of wire having a loop 106 at one end encircling a transversal bar 108 on which it is adapted to slide. The other end of the handles 102 extend through another loop 108 formed at the front end of the brackets 104. When the handles 102 are not needed, they are pushed one against the other. They are pulled away from each other to exceed outside the loops 108 as shown in FIG. 10 when used.

The leg member 80 is constituted by the transversal bar 110 and two pending rods 112 adapted to reach the floor 114 surrounding the cabinet 90. Such a leg member 80 constitutes an additional security for the support of the bottle 82. Considering that the transversal bar 110 and the rods 112 can pivot, the bottom of the legs are preferably provided with a flat portion 116 for preventing unintentional pivoting action. The flat portion 116 is connected to the rod 112 so that it generally lies on a plane below the vertical axis of the rods 112.

Figure 6:
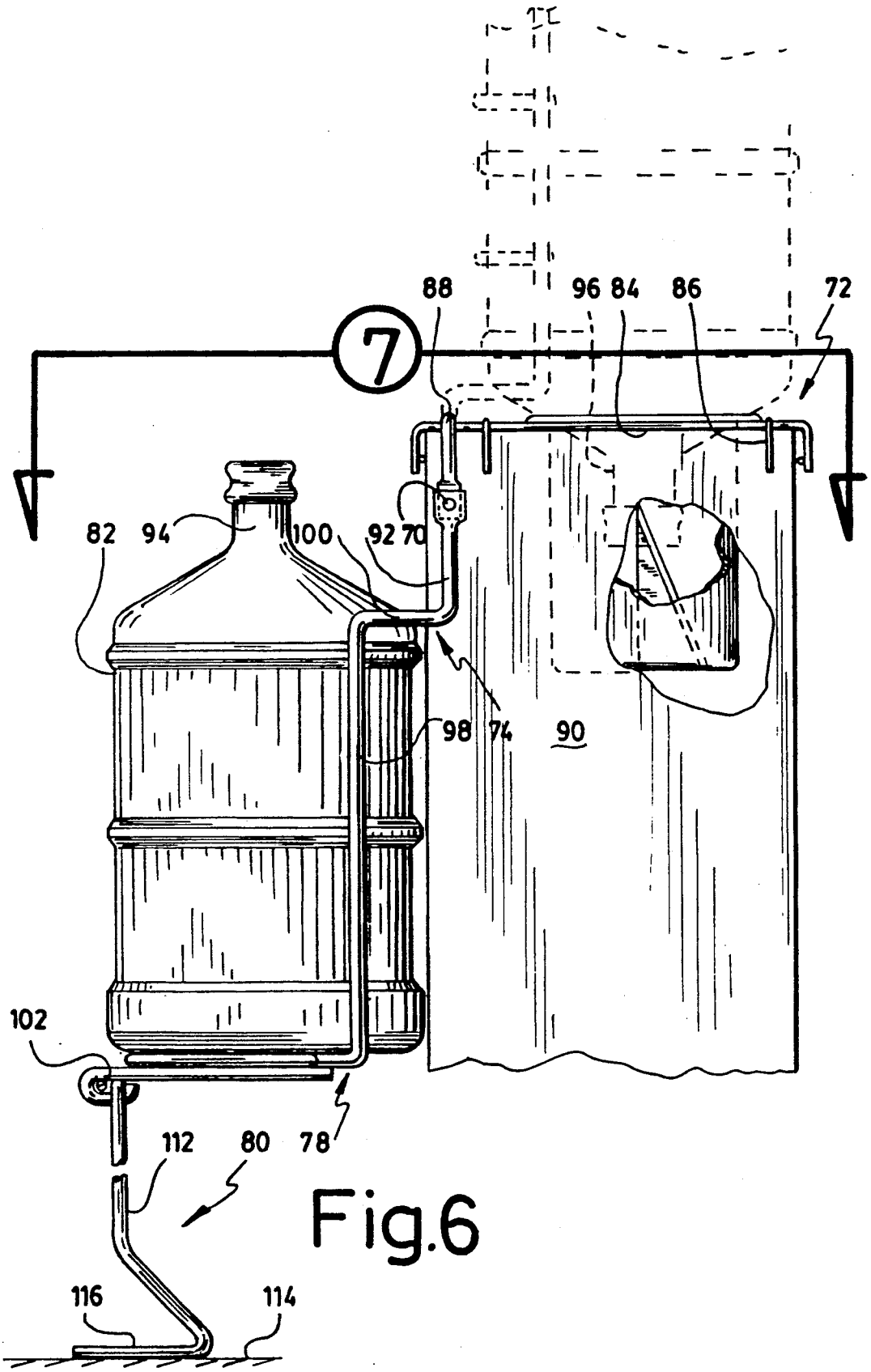
FIG. 6 is an elevation view of an alternative embodiment of the tilting assembly shown in FIG. 1.
Figure 7:
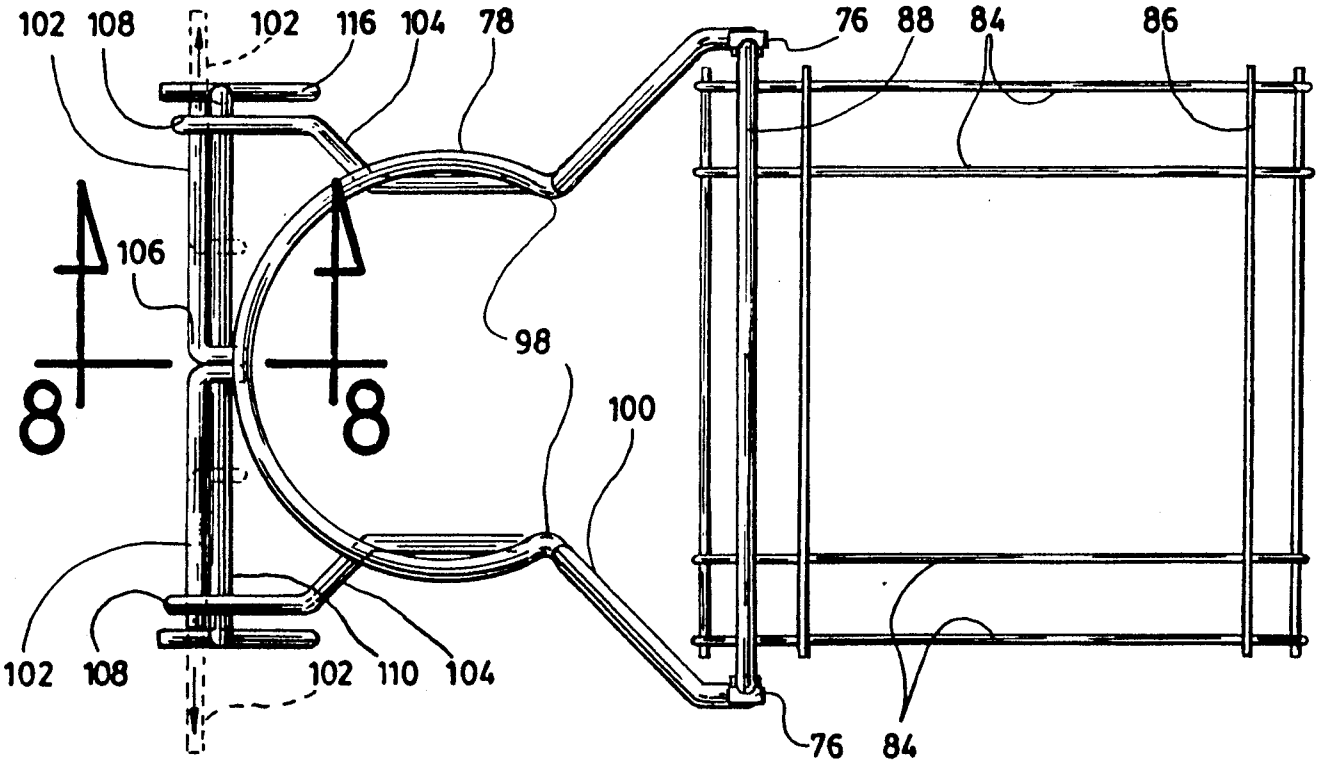
FIG. 7 is a top view of FIG. 6 along arrow 7 shown in FIG. 6.
Figure 8:
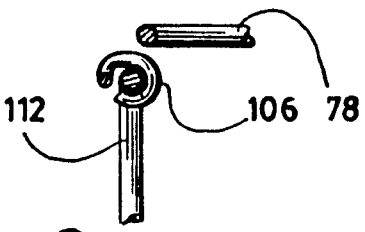
FIG. 8 is a cross-sectional view taken along line 8—8 of FIG. 7.
Figure 6A:
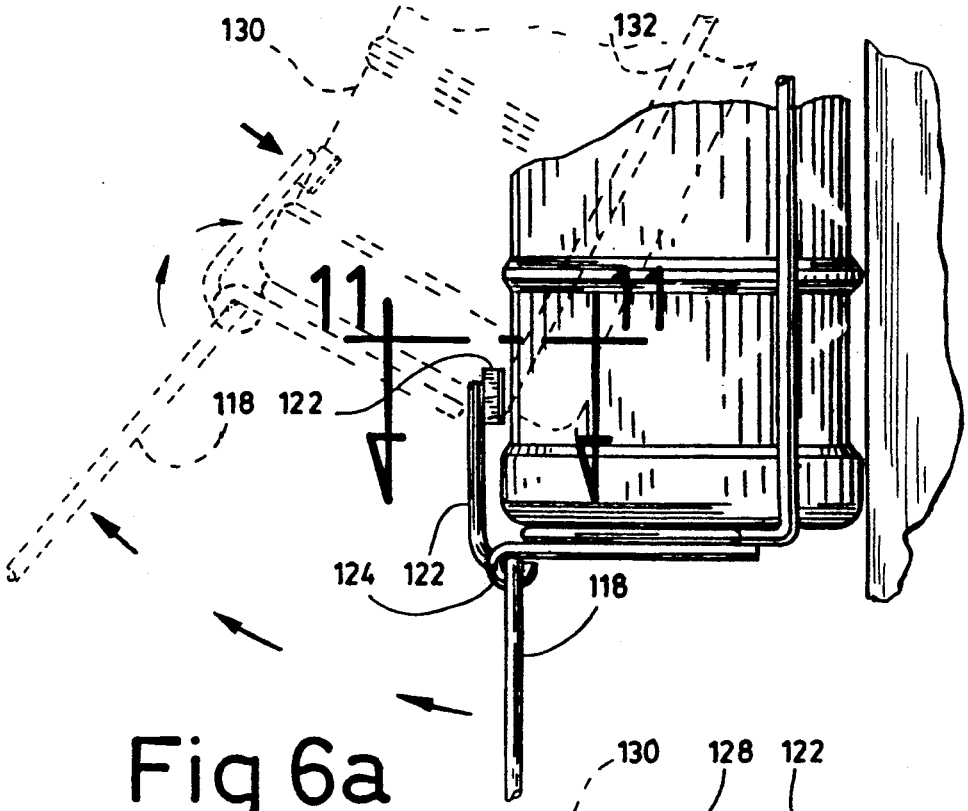
FIG. 6*a* illustrates an elevation view of an alternative embodiment shown in FIG. 6.
Figure 11:
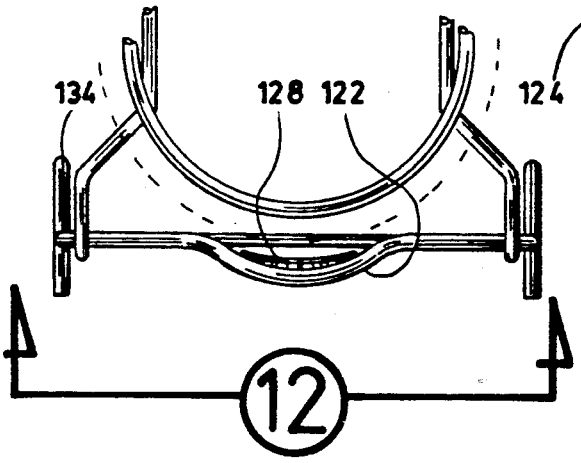
FIG. 11 is a cross-sectional view taken along line 11—11 of FIG. 6*a*.
Figure 12:
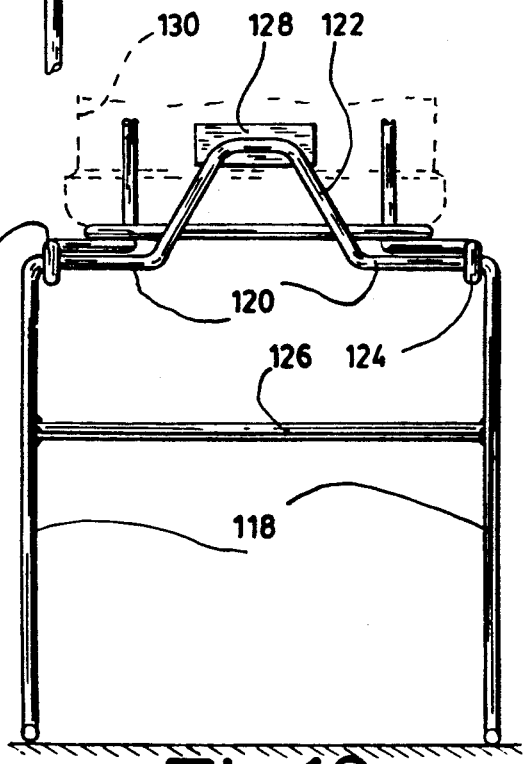
FIG. 12 is a front view taken along arrow 12 shown in FIG. 11.

An alternative embodiment for the leg members is shown in FIGS. 6*a*, 11 and 12. This leg arrangement displays a frontal archway including a pair of pending rods 118 connected at the top by a transversal rods 120 partly projecting upwardly forming a bow 122. The transversal rods 120 are pivotally mounted in loops 124 and allows the pending rods 118 to pivot therethrough. A handle bar 126 connects the two rods 118 and is used to tilt the bottle in its upside down position. When the handle bar 126 is pulled, the bow 122 is pushed against an abutting plate 128 which automatically holds the bottle against the lateral beam 132 and prevents it from unintentionally slipping away.

The pending rods 118 may also be provided with a lower flat portion 134 such as portion 116 shown in FIG. 6.

We claim:

1. A self-contained water bottle tilting assembly for a water bottle having a restricted sized neck and a mouth covered by a breakable seal, said assembly adapted to be mounted on a water dispensing unit made of a cabinet having an upper surface, a peripheral wall including a pair of opposite lateral walls and a front wall, and an opened trough extending inside said upper surface for receiving water from said bottle, said assembly comprising, frame means having a collar member for sitting on said upper surface and for gripping said water dispensing unit around said peripheral wall at a level adjacent said upper surface, and a pair of spaced lateral beams pending from said collar member adapted to be positioned adjacent said peripheral wall on each side of said lateral walls, said beams adapted to be located forwardly of said front wall, pivoting means connecting each of said lateral beams and said collar member for pivoting said lateral beams from a pending position to an upwardly extending position, said lateral beams adapted to tilt said bottle and laterally support it during its tilting operation, a platform fixed to each of said lateral beams for supporting said bottle adjacent said beams in an upstanding position, said pivoting means having a pair of coaxially aligned axles adapted to be located on each side of said lateral walls for tilting said bottle from its upstanding position to an upside down position with its mouth located for facing said trough, and a piercing means adapted to be located in said trough for piercing said seal when said bottle approaches its upside down position, whereby the water in the bottle is adapted to flow in the trough.

2. A water bottle tilting assembly as recited in claim 1, comprising a strap member fixed to said lateral beam above said platform, said strap member adapted to releasably hold said bottle against said beam.

3. A water bottle tilting assembly as recited in claim 2, comprising a handle member laterally extending from said platform, said handle adapted to pivot said platform and said bottle mounted thereon about said axle.

4. A water bottle tilting assembly as recited in claim 1, comprising a leg pending from said platform adapted to rest at a location away from said dispensing unit and extending down to the floor, said leg adapted to support said platform on said floor.

5. A water bottle tilting assembly as recited in claim 4, wherein said leg comprises an upwardly extending arm adapted to abut against the bottle in the direction of the lateral beam, whereby said bottle is held between said beams and said arm when being tilted.

6. A water bottle tilting assembly as recited in claim 1, wherein said piercing means comprises two adjacent and angularly disposed faces of a hollow pyramid.

7. A water bottle tilting assembly as recited in claim 6, wherein said two faces are disposed at 90 degrees to each other.

8. In a water dispensing unit made of a cabinet having an upper surface, a peripheral wall including a pair of opposite lateral walls and a front wall, and an open trough extending inside said upper surface, and piercing means located in said trough adapted to receive water from a water bottle having a restricted sized neck and a mouth covered by a breakable seal, the improvement being characterized by a tilting assembly adapted to be mounted on said unit, said assembly comprising, frame means having a collar member for sitting on said upper surface and for gripping said water dispensing unit around said peripheral wall at a level adjacent said upper surface, and a pair of spaced lateral beams pending from said collar member adjacent said peripheral wall on each side of said lateral walls, said beam extending downwardly and forwardly of said front wall, pivoting means connecting each of said lateral beams and said collar member for pivoting said lateral beams from a pending position to an upwardly extending position, said lateral beams adapted to tilt said bottle and laterally support it during its tilting operation, a platform fixed to each of said lateral beams for supporting said bottle adjacent said beams in an upstanding position, said pivoting means having a pair of coaxially aligned axles located on each side of said lateral walls for tilting said bottle from its upstanding position to an upside down position with its mouth located for facing said trough, whereby said piercing means is adapted to pierce said seal when said bottle approaches its upside down position, to allow the water in the bottle to flow in the trough.

* * * * *